US010542809B2

(12) United States Patent
Maletti

(10) Patent No.: US 10,542,809 B2
(45) Date of Patent: Jan. 28, 2020

(54) WASHING STATION WITH COVER

(71) Applicant: MALETTI S.P.A., Fellegara di Scandiano (IT)

(72) Inventor: Guido Maletti, Scandiano (IT)

(73) Assignee: Maletti S.P.A., Fellegara di Scandiano (IT)

( * ) Notice: Subject to any disclaimer, the term of this patent is extended or adjusted under 35 U.S.C. 154(b) by 0 days.

(21) Appl. No.: 15/982,113

(22) Filed: May 17, 2018

(65) Prior Publication Data

US 2019/0159567 A1 May 30, 2019

(30) Foreign Application Priority Data

Nov. 27, 2017 (IT) ..... 102017000135947

(51) Int. Cl.

| | |
|---|---|
| ***A45D 19/10*** | (2006.01) |
| ***A45D 19/14*** | (2006.01) |
| ***A45D 19/06*** | (2006.01) |
| ***A45D 19/04*** | (2006.01) |
| ***A45D 19/16*** | (2006.01) |
| ***A45D 19/00*** | (2006.01) |

(52) U.S. Cl.

CPC ..... *A45D 19/10* (2013.01); *A45D 19/04* (2013.01); *A45D 19/06* (2013.01); *A45D 19/14* (2013.01); *A45D 19/16* (2013.01); *A45D 2019/0058* (2013.01); *A45D 2019/0066* (2013.01)

(58) Field of Classification Search

CPC ..... A45D 19/10

USPC ..... 4/515–523

See application file for complete search history.

(56) References Cited

U.S. PATENT DOCUMENTS

| | | | | |
|---|---|---|---|---|
| 3,416,517 | A * | 12/1968 | Adams et al. | A45D 19/14 132/207 |
| 5,099,865 | A * | 3/1992 | Flannery | A45D 19/14 132/212 |
| 6,161,227 | A * | 12/2000 | Bargenquast | A47K 1/04 134/58 R |
| 2005/0015873 | A1* | 1/2005 | Hansen | A45D 19/10 4/519 |
| 2011/0239363 | A1* | 10/2011 | Nagamatsu | A45D 19/06 4/519 |

FOREIGN PATENT DOCUMENTS

EP 2371235 A1 10/2011

* cited by examiner

*Primary Examiner* — Christine J Skubinna
(74) *Attorney, Agent, or Firm* — Pearne & Gordon LLP

(57) ABSTRACT

A station for the treatment of hair, comprising: a washbasin (2), provided with a seat (21) for enabling a user to rest his/her neck and a drain (9) for draining the water from the washbasin (2); a dispenser (3) for dispensing steam inside the washbasin; a spray head (8) with an attached mixer tap (81) for dispensing hot or cold water; a cover (4) associated with the washbasin (2) to take on at least a closed position, in which it defines, together with the washbasin (2) a working space (V), and an open position; wherein the cover (4) comprises a window (41) to enable the users face to protrude outside of the working space (V).

The cover (4) comprises a pair of openings (42) arranged to enable insertion of an operator's hands inside the space (V).

11 Claims, 6 Drawing Sheets

WASHING STATION WITH COVER

The present invention relates to a station for hair treatment.

Hair treatment, and in particular colouring, is increasingly making use of compounds based on natural products. Hair colouring makes use of colourants based on natural pigments, which are considerably less aggressive and polluting than more conventional products. Since they are less aggressive, natural colourants have a lesser tendency to fix and adhere to the hair. To promote the fixing of the colourants, the hair is preferably treated by heating it with water steam. This treatment opens the structure of the hairs, so that the colourant is able to penetrate more effectively into the hairs and fix itself to them.

In the prior art, stations comprising a washbasin equipped with a nozzle to dispense the steam are known. The washbasin has a seat on which the neck rests, so that the head and hair are substantially inside the washbasin itself. The washbasin is equipped with a cover which can assume at least one closed position in which it is superposed over the washbasin itself, closing it partially so as to contain the top of the head and the hair, leaving the face free. The cover retains a substantial amount of the steam, preventing it from dispersing, and hence reducing the amount needed to be dispensed for effective treatment.

In current stations, the cover obstructs access to the hair when it is in the closed position. This means that, whenever the operator must touch the hair or head, for example to apply a product or rub a product in, the cover must be raised to an open position, dispersing the enclosed steam. Furthermore, the repeated movement of the cover between the open and closed positions is somewhat inconvenient.

The aim of the present invention is to provide a station for hair treatment which obviates the drawbacks of currently available stations.

An advantage of the station according to the present invention is that it considerably reduces the dispersal of steam.

Another advantage of the station according to the present invention is that it considerably facilitates the work of the operator.

Further characteristics and advantages of the present invention will become more apparent in the following detailed description of an embodiment of the present invention, illustrated by way of non-limiting example in the attached figures, in which.

Figure 1:
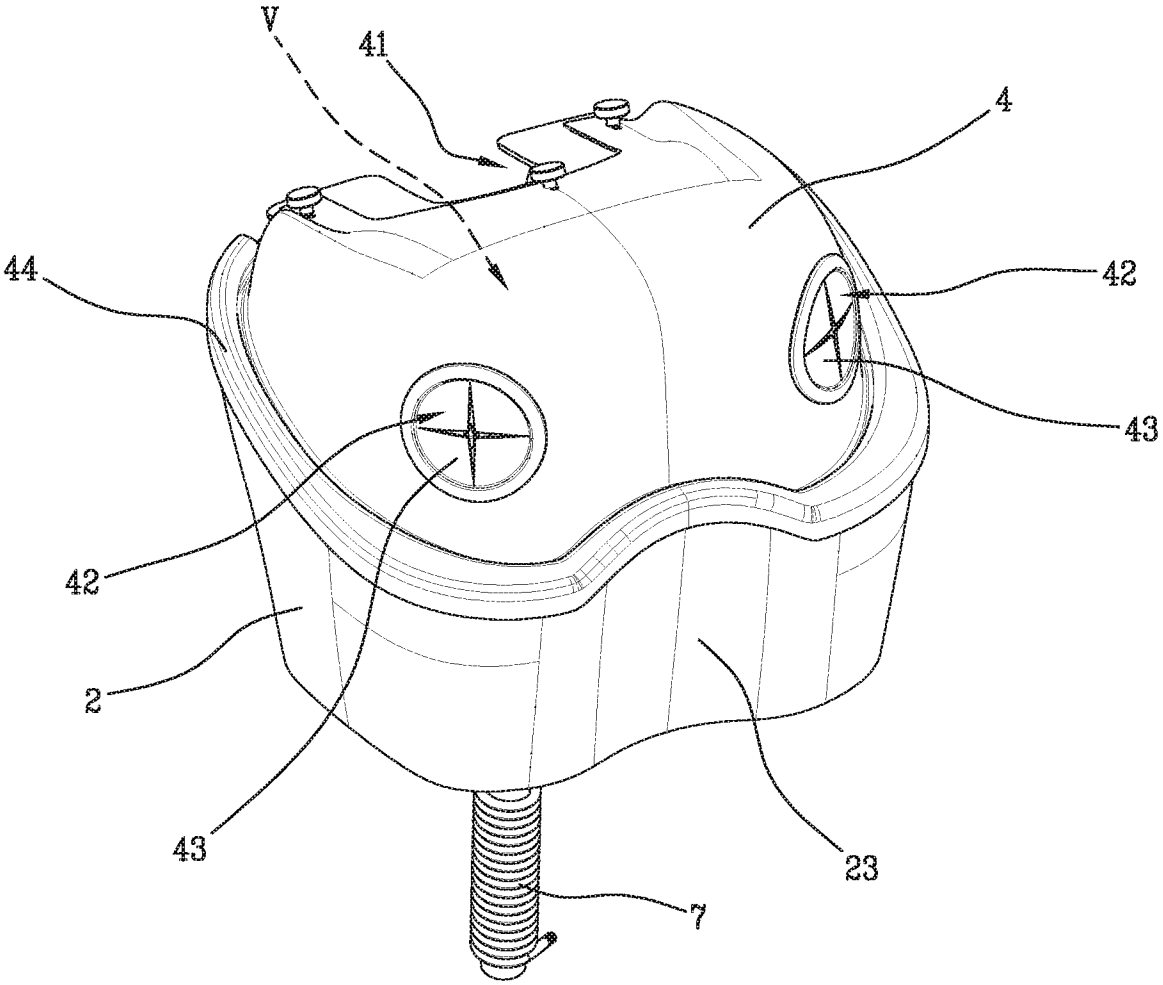
FIG. 1 is a front perspective view of a washing station with cover according to the present invention.
Figure 2:
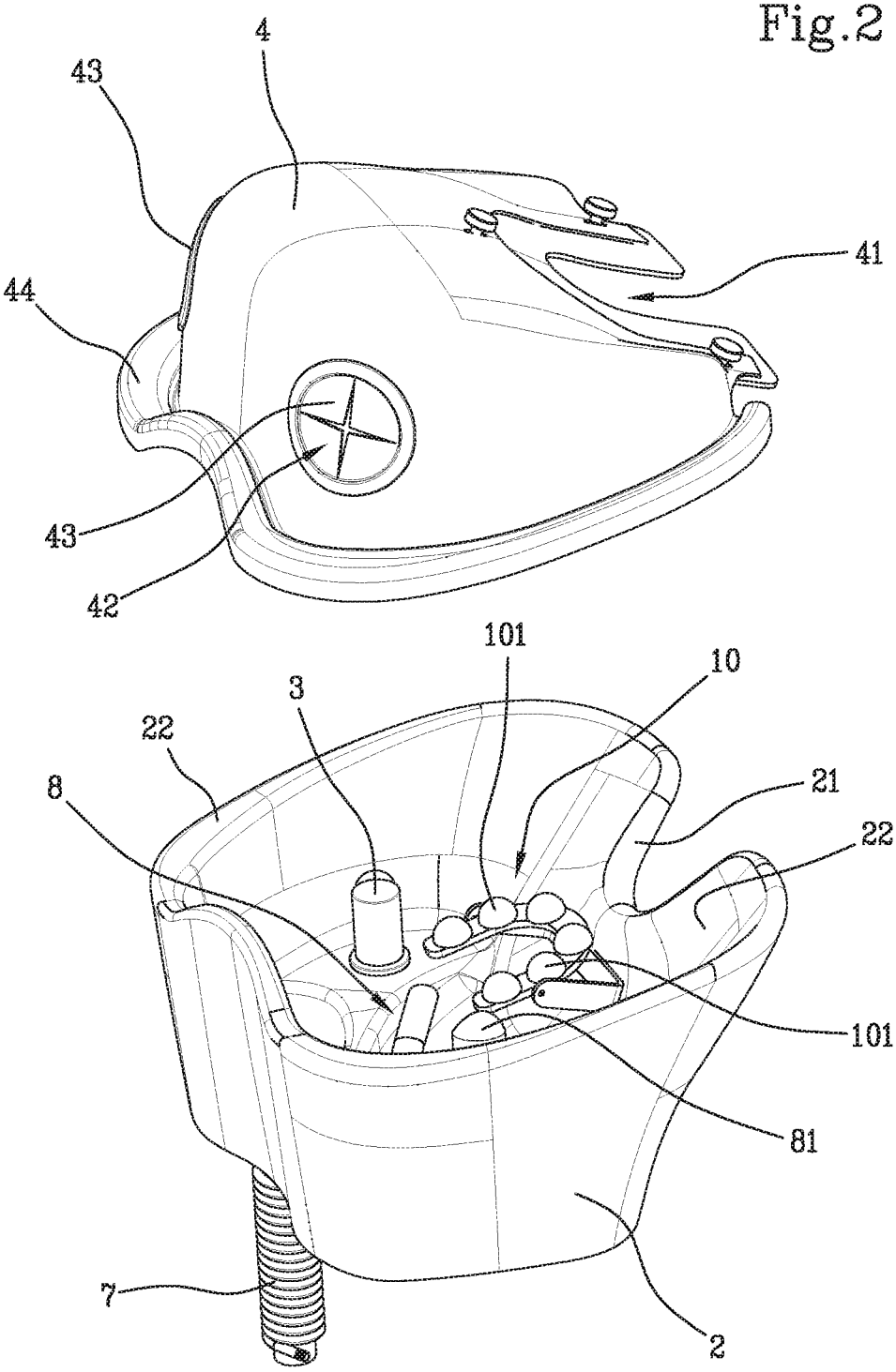
FIGS. 2-4 are perspective views of the washing station with the cover raised to better illustrate some components of the station.
Figure 3:
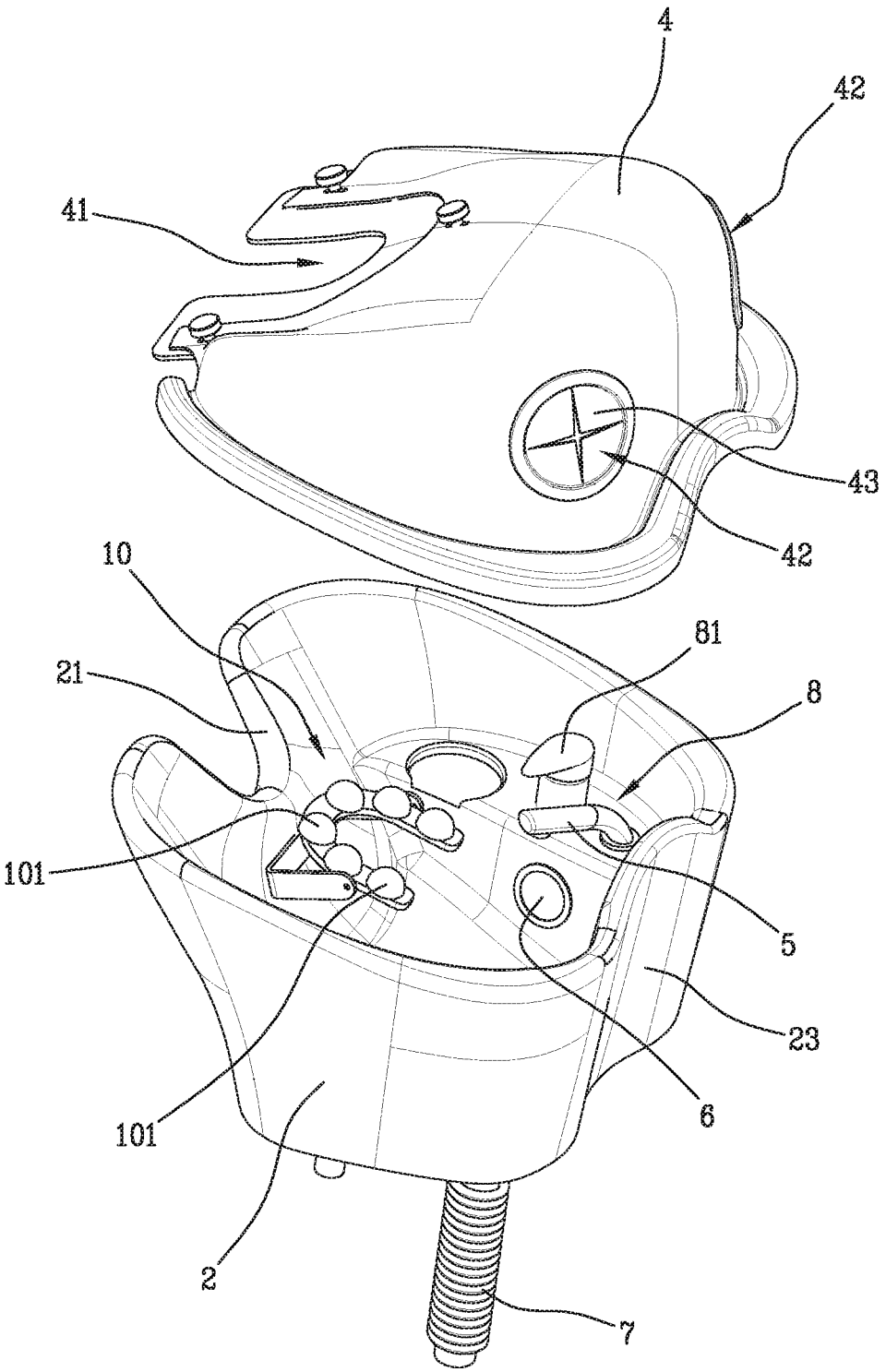
Figure 4:
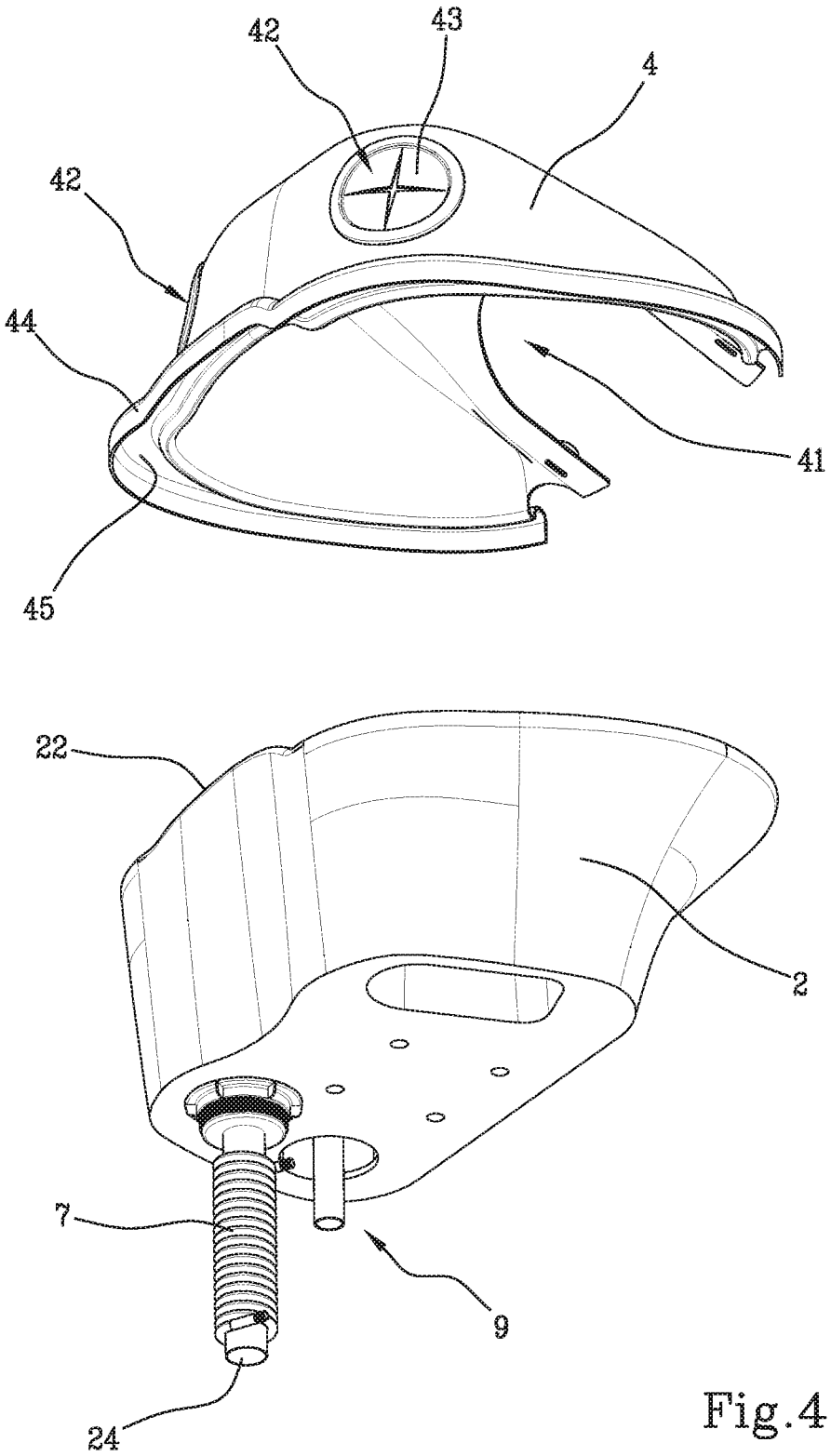
Figure 5:
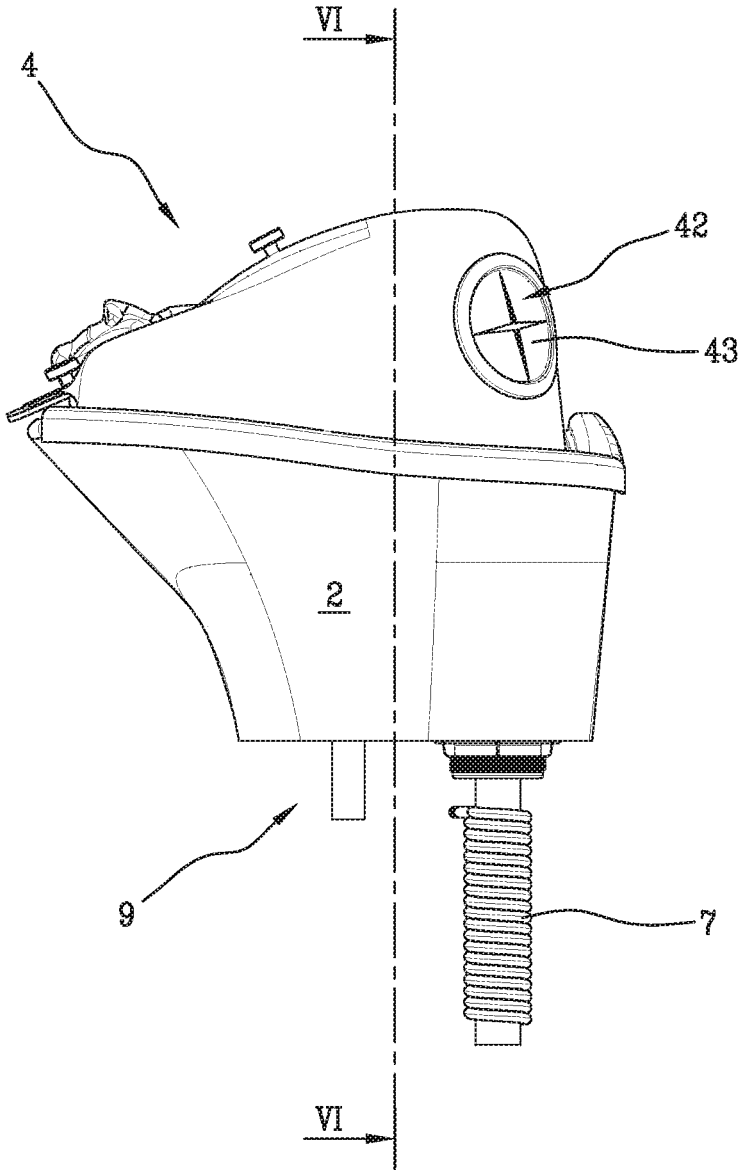
FIG. 5 is a lateral view of the washing station of FIG. 1.
Figure 6:
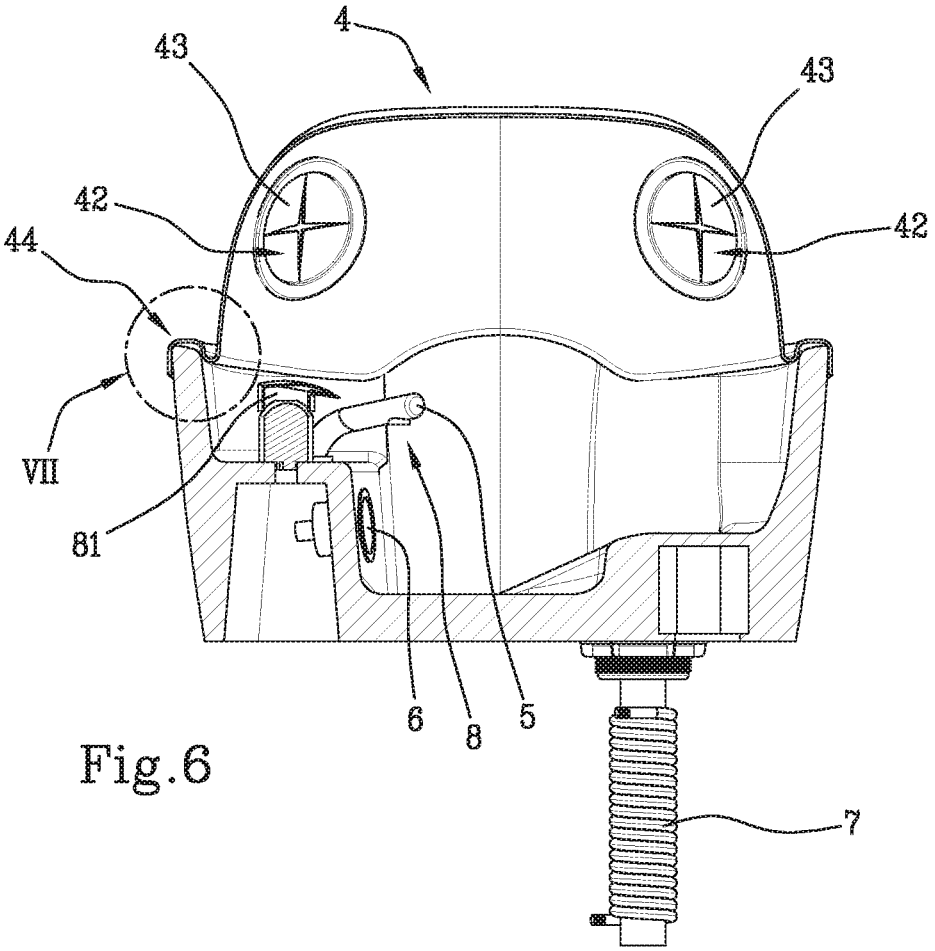
FIG. 6 is a cross-sectional view of the washing station according to the V-V plane of FIG. 5.

The station for hair treatment according to the present invention comprises a washbasin (2), provided with a seat (21) for enabling a user to rest his/her neck and a drain (9) for draining the water from the washbasin (2). In substance, the washbasin (2) is delimited by a side wall which, in a front zone, forms a U-shaped cavity which, in a known way in the art, supports the back of the neck, with the face facing upwards. In a known way, the washbasin (2) may be associated with a chair (not illustrated).

The washbasin (2) comprises a spray head (8) with an attached mixer tap (81) for dispensing hot or cold water.

The washbasin (2) also comprises, located at the seat (21), a headrest (10) equipped with rubber or gel inserts (101) of anatomic shape.

The station further comprises a dispenser, pivotable by means of rotation through 360° (3), predisposed for dispensing steam into the washbasin (2). The dispenser (3) may be associated to an inner surface of the washbasin (2). A supply pipe, not illustrated, connects the dispenser (3) to an external source of steam, not illustrated.

The possibility of pivoting the dispenser enables the flow of steam to be directed to particular areas.

A cover (4) is associated to the washbasin (2) to assume at least a closed position, in which it defines, together with the washbasin (2), a working space (V). The cover (4) has a rounded conformation, with the concavity facing towards the washbasin (2).

In the illustrated embodiment, the cover (4) comprises a concave lower edge (44) which defines a seat (45) that is complementarily shaped to an upper edge (22) of the washbasin (2). In the closed position, the cover (4) is thus arranged above the washbasin (2), delimiting, together with the latter, the space (V) which is substantially closed, with the exception of the opening delimited by the seat (21) of the washbasin, necessary to enable the insertion of the user's head. In the closed position of the cover (4), the upper edge (22) of the washbasin (2) is disposed inside the seat (45), forming a barrier against the discharge of liquid from the working space (V). The seat (45) may potentially be fitted with a gasket.

The cover (4) further comprises a window (41), substantially aligned with the seat (21), to enable the face of the user to face upwards and protrude out of the cover (4) itself.

Unlike currently available stations, in the station according to the present invention the cover (4) comprises a pair of openings (42) arranged to enable insertion of an operator's hands inside the space (V). In substance, thanks to the presence of the openings (42) passing through the cover (4), the operator may access the inside of the space (V) even when the cover (4) is in the closed position. This enables the operator to work directly with the hair of the user without needing to raise or move the cover (4) into an open position, and thus considerably limits the dispersal of the steam inside the space (V).

To further limit the dispersal of steam, the openings (42) are provided with a flexible membrane (43) that has an at-rest configuration in which it occludes the openings (42). For example, the flexible membrane (43) may be composed of a layer of elastomeric material provided with one or more through cuts. When not subjected to force, the flexible membrane (43) remains in a substantially flat configuration, in which the optional cuts are adjacent to each other and closed, thus occluding the relative opening (42). When a hand is inserted through the opening (42), the membrane (43) is deformed, allowing the hand to pass through but remaining attached to the hand and wrist. Even when the hands are inserted through the openings (42) the dispersal of steam is extremely limited, due to the presence of the flexible membrane (43).

The dispenser (3) may be provided with a reservoir configured to release an essential oil or an oil of another nature into the flow of steam. The reservoir may be in the form of a ring, configured so that the flow of steam passes through it, and predisposed to be moistened or impregnated with an essential oil.

The openings (42) are preferably arranged in a position opposite to the window (41). In this way, the operator is located substantially behind the user, and can thus approach the cover (4) without impediment. The operator can thus work in comfort, while the user is not inconvenienced by the operator in any way.

To further facilitate the work of the operator, the washbasin (2) comprises a recess (23), located in an intermediate position with respect to the openings (42). In other words, the recess (23) is defined by a concave portion facing towards the interior of the washbasin (2), which enables the operator to further approach the cover (4).

The presence of the cover (4) provided with openings (42) makes it possible to provide a nozzle (5) for dispensing a fluid at high pressure inside the washbasin (2). The nozzle (5) may be used to direct a high pressure jet of water towards the hair or head of the user, for deep washing or massage, for example.

Figure 7:
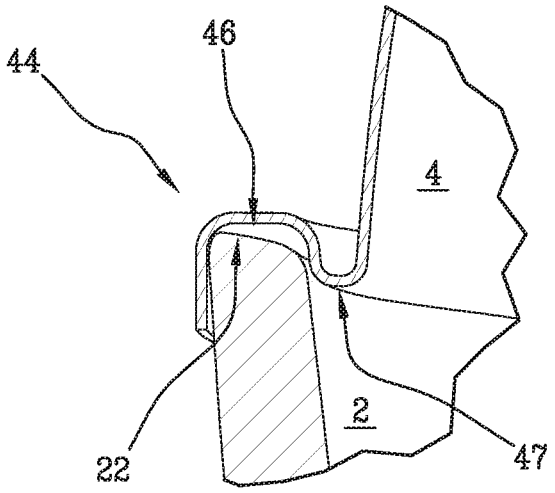
FIG. 7 is an enlarged detailed view of a constructional detail of the washing station.

The nozzle (5) may be associated, for example, with a mobile tap, connected to a pump by means of a flexible pipe which passes, in a known way, through an opening in the washbasin (2). The operator can introduce his/her hands through the openings (42) to access the nozzle (5) and grip and/or manoeuvre it inside the space (V). The cover (4) retains the inevitable splashes inside the washbasin (2). Thanks to the presence of the concave lower edge (44) of the cover (4), which defines a seat (45) complementarily shaped to an upper edge (22) of the washbasin (2), the flow of water along the inner wall of the cover (4) is also retained inside the washbasin (2). With reference to FIG. 7 it can be seen that the lower edge (44) has a first contour (46), resting on the upper edge (22) of the washbasin, from which a lip (47) extends away from the first contour (46) towards the interior of the washbasin (2).

In this way, the lower edge (44) acts as a drip retainer both for the splashes of water, which do not exit the space V, and for the steam condensation which from the lip (47) cannot rise over the first contour (46).

In this way the cover (4) protects the operator from any contact with chemical products or water.

The station according to the present invention may further be provided with a light source (6), applied to an inner wall of the washbasin (2). The light source (6) enables a clear view of the head and hair of the user even when there is steam inside the cover (4) and the working space (V).

To further increase the energy efficiency of the station, a heat exchanger (7) may be interposed between a drain pipe (24) of the washbasin (2) and a supply pipe to the nozzle (5). The heat exchanger (7) may preferably be made in a conductive metal material, for example copper or titanium.

The heat exchanger (7) may be made in the form of a pipe wound in a spiral (carrying the cold water supply to the washbasin's mixer tap) around the washbasin's drain pipe (24), as shown in the figures. The steam which condenses in contact with the cover (4) and the washbasin (2) retains a certain amount of heat which is transferred, at least in part, to the fluid running through the heat exchanger (7). The heat exchanger (7) may be inserted along the supply pipe to the nozzle (5) so that the fluid, i.e. water, can be heated before being dispensed.

The invention claimed is:

1. A station for hair treatment, comprising: a washbasin (2) provided with a seat (21) for enabling a user to rest his/her neck and a drain (9) for draining the water from the washbasin (2); a spray head (8) with an attached mixer tap (81) for dispensing hot or cold water; a pivotable dispenser (3) for dispensing steam inside the washbasin; a cover (4) associated with the washbasin (2) to take on at least a closed position, in which it defines, together with the washbasin (2) a working space (V), and an open position; wherein the cover (4) comprises a window (41) to enable the user's face to protrude outside of the working space (V);

characterized in that the cover (4) comprises a pair of openings (42) arranged to enable insertion of an operator's hands inside the space (V);

each opening (42) being formed about a respective axis which defines an insertion direction of an operator's hand through the opening, wherein the openings (42) are made on non-parallel regions of the cover (4) so that the axes of the openings (42) are converging according to an insertion direction of the hands through said openings (42).

2. A station according to claim 1, wherein the openings (42) are provided with a flexible membrane (43) that has an at-rest configuration in which it occludes the openings (42).

3. A station according to claim 2, wherein the openings (42) are arranged in a position opposite the window (41).

4. The station according to claim 1, comprising a nozzle (5) for dispensing a fluid at high pressure.

5. The station according to claim 1, wherein the cover (4) comprises a concave lower edge (44) that defines a seat (45) that is complementarily shaped to an upper edge (22) of the washbasin (2).

6. The station according to claim 1, wherein the washbasin (2) comprises a recess (23) located in an intermediate position with respect to the openings (42).

7. The station according to claim 1, wherein the dispenser (3) comprises a reservoir configured to release an essential oil or an oil of another nature into the flow of steam.

8. The station according to claim 1, comprising a light source (2) applied to an inner wall of the washbasin (2).

9. The station according to claim 1, comprising a heat exchanger (7) interposed between a drain pipe (24) of the washbasin (2) and a supply pipe to the nozzle (5).

10. The station according to claim 1, comprising an armchair with which the washbasin (2) is associated.

11. The station according to claim 1, comprising a headrest (10) located in the proximity of the seat (21) of the washbasin (2), said headrest (10) being rotatable and equipped with anatomic inserts (101).

* * * * *